US005498033A

United States Patent [19]

Hoshizaki et al.

[11] Patent Number: 5,498,033

[45] Date of Patent: Mar. 12, 1996

[54] SKATE BOOT WITH MOLDED PLASTIC OVERLAY

[75] Inventors: T. Blaine Hoshizaki, Montreal West; Jeffrey J. Acheson, Weston; Gerald Black, Cambridge, all of Canada

[73] Assignee: Canstar Sports Group Inc., Ville Mont-Royal, Canada

[21] Appl. No.: 159,134

[22] Filed: Nov. 30, 1993

[30] Foreign Application Priority Data

Dec. 8, 1992 [CA] Canada ..... 2084829

[51] Int. Cl.[6] ..... A43B 7/14

[52] U.S. Cl. ..... 280/841; 36/89; 36/115; 36/69

[58] Field of Search ..... 280/841, 11.12, 280/11.19; 36/89, 105, 107, 115, 136, 68, 69, 585

[56] References Cited

U.S. PATENT DOCUMENTS 4,509,276 4/1985 Bourgue ..... 36/115
4,655,465 4/1987 Schaeffer ..... 280/11.12
4,835,885 6/1989 Hoshitaki et al. ..... 36/115
5,342,070 8/1994 Miller et al. ..... 36/115

*Primary Examiner*—Richard M. Camby
*Attorney, Agent, or Firm*—R. Craig Armstrong

[57] ABSTRACT

A skate boot is described, having a plastic overlay sewn or otherwise secured to the boot of the skate, wrapping around the heel of the boot from the medial to the lateral side of the ankle. The overlay increases the rigidity of the rear of the skate, to restrict pronation and supination, while adding impact resistance. Preferably, in order to permit dorsal and plantar flexion, the plastic overlay has several cut-out areas which allow for a controlled amount of flexion about a lateral axis, namely a heel flex cut-out area and side flex cut-out areas on either side in the instep area. Flexible inserts are preferably installed in the cut-out areas, to maintain extra impact protection while permitting flexion.

8 Claims, 6 Drawing Sheets

A-A

B-B

C-C

D-D

E-E

SKATE BOOT WITH MOLDED PLASTIC OVERLAY

BACKGROUND OF THE INVENTION

This invention relates to ice skates, and especially but not necessarily exclusively to those used for ice hockey.

In ice hockey, it is essential for the player to have a skate which is as rigid as possible, especially in terms of resistance to supination and pronation, i.e. movement about a longitudinal axis of the foot. Such rigidity provides the player with direct control over the skate blade edges, which is essential to controlled, balanced and powerful skating.

At the same time, the skate cannot be too rigid, particularly in terms of dorsal and plantar flexion, i.e. movement about a lateral axis, because the player has to be able to flex his ankle normally, to maximize power and control.

Also, since injury to the foot and ankle through impact is always a concern, whether through impact from a hockey puck or via a deliberate or accidental slash from a hockey stick, impact protection is highly desirable.

SUMMARY OF THE INVENTION

It is therefore an object of the invention to provide a skate which improves the overall strength and rigidity of the skate boot, particularly in terms of restricting supination and pronation, i.e. movement about a longitudinal axis.

It is a further object of the invention to provide improved impact protection.

Preferably, the invention restricts supination and pronation, but permits a certain amount of dorsal and plantar flexion, i.e. movement about a lateral axis.

In the invention, therefore, a relatively thick and therefore somewhat inflexible plastic overlay is sewn or otherwise secured to the boot of the skate, wrapping around the heel of the boot from the medial to the lateral side of the ankle. The overlay increases the rigidity of the rear of the skate, while obviously adding impact resistance.

Preferably, in order to permit dorsal and plantar flexion, the plastic overlay has several cut-out areas which allow for a certain amount of such flexion. For example, a heel flex cut-out area may be provided, and side flex cut-out areas may be provided on either side near the dorsal or instep area. Flexible inserts may be installed in the cut-out areas if desired, to maintain extra impact protection while permitting flexion.

Further features of the invention will be described or will become apparent in the course of the following detailed description.

BRIEF DESCRIPTION OF THE DRAWINGS

In order that the invention may be more clearly understood, the preferred embodiment thereof will now be described in detail by way of example, with reference to the accompanying drawings, in which.

DETAILED DESCRIPTION OF THE PREFERRED EMBODIMENT

Figure 1:
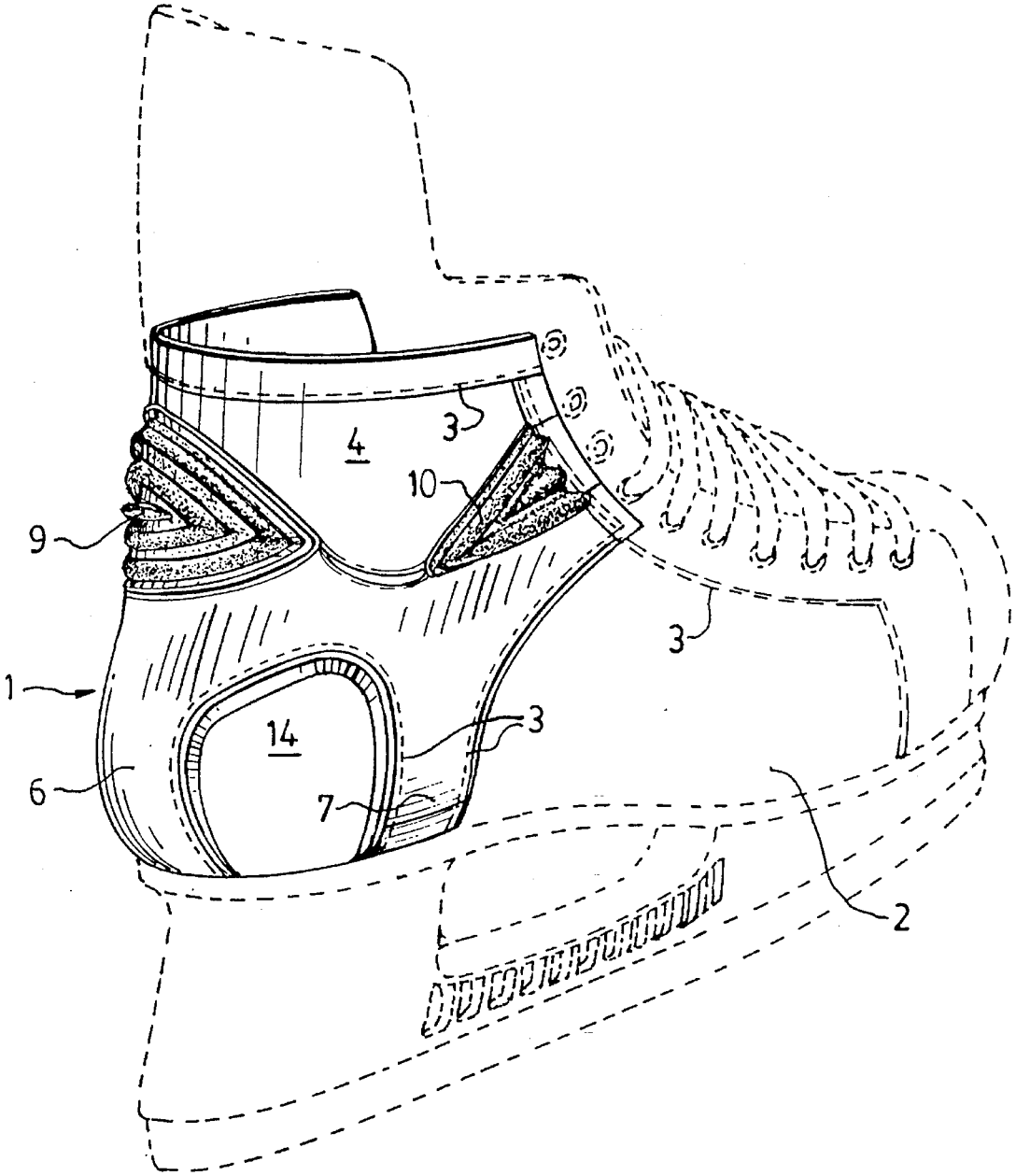
FIG. 1 is a perspective view of a skate with the preferred configuration of plastic overlay.
Figure 2:
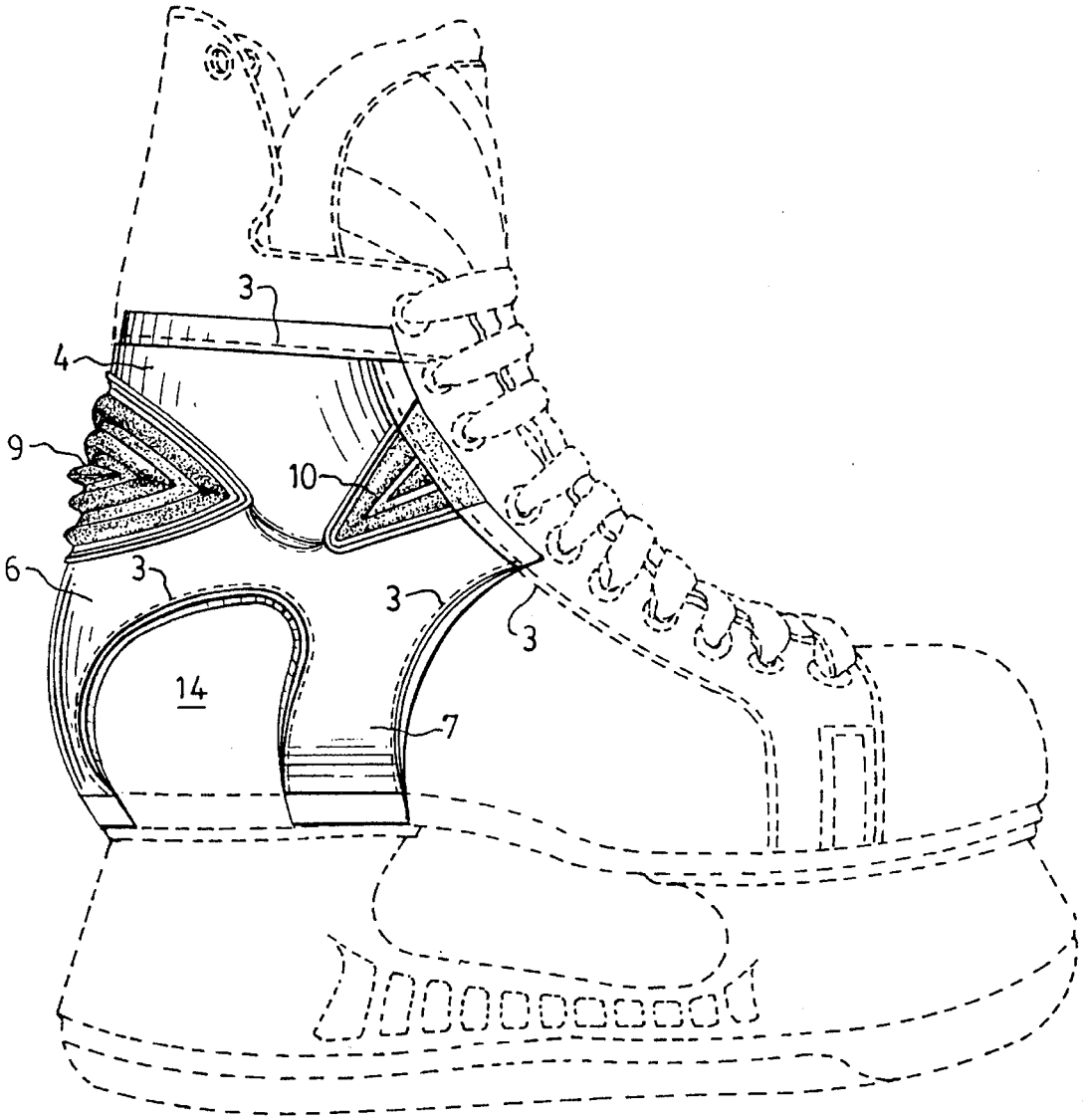
FIG. 2 is a side view of the skate.
Figure 3:
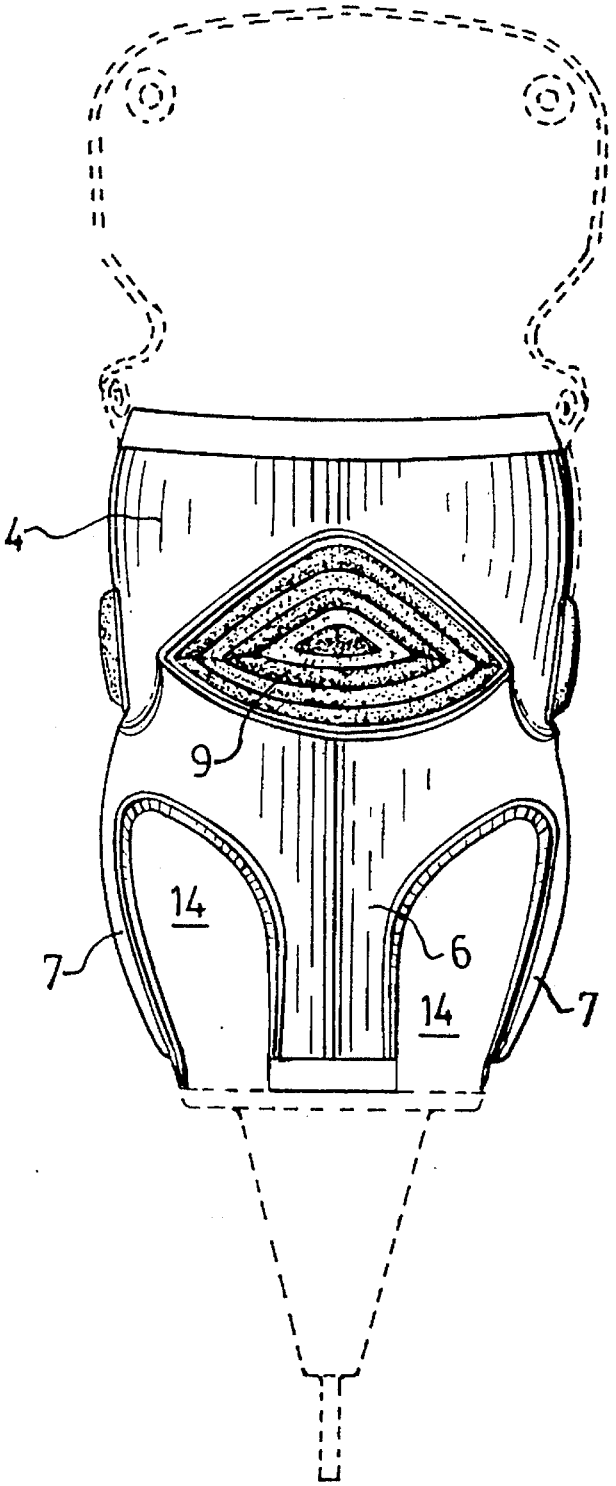
FIG. 3 is a back view of the skate.
Figure 4:
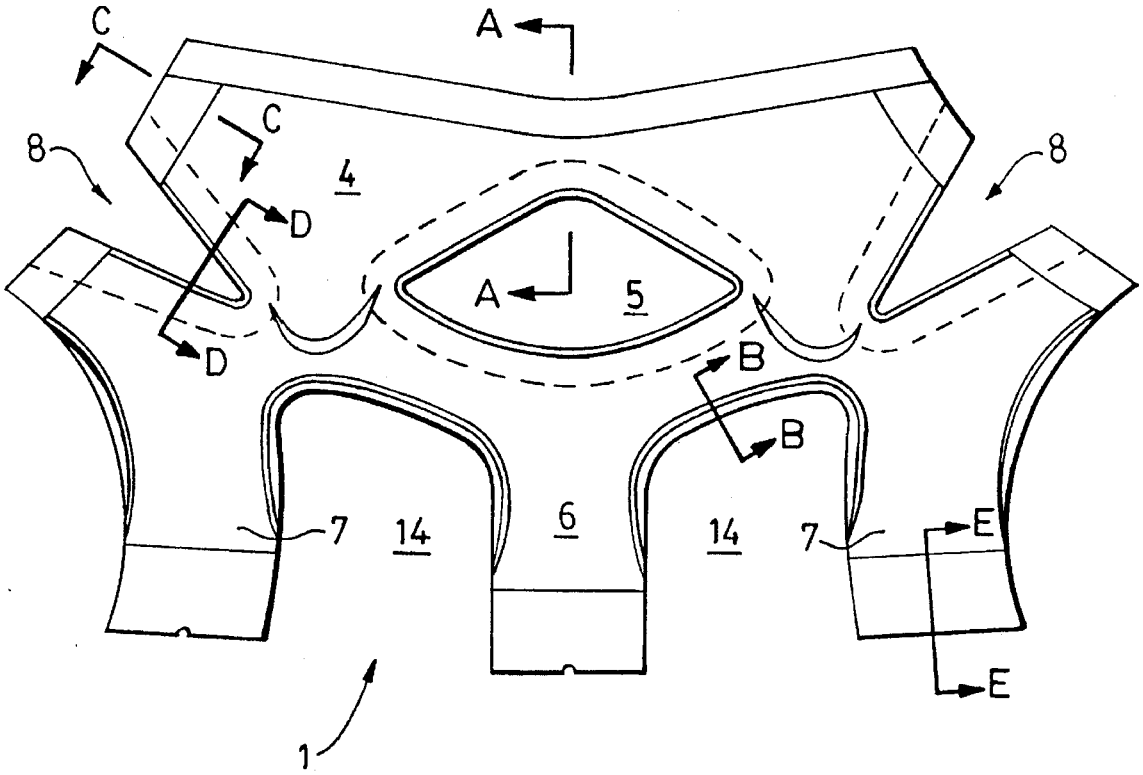
FIG. 4 is a plan view of the overlay, laid out flat.

As illustrated in the drawings, a plastic overlay 1 is secured to the skate boot 2, by any suitable means such as sewing 3. Preferably, the overlay is injection molded, and in the mold is preshaped to approximately the shape of the boot heel. The overlay has an upper portion 4 with a heel flex cut-out area 5, an integral lower rear portion 6, and integral side panels 7. V-shaped side cut-out areas 8 are provided towards the upper side edges of the upper portion. Preferably, flexible inserts are positioned in the cut-out areas, namely a heel flex insert 9 and two side flex inserts 10.

As can be appreciated from the drawings, the cut-out areas permit flexion of the skate about a lateral axis through the malleoli, corresponding with the natural dorsal and plantar flexion of the foot. In dorsal flexion, i.e. as the player moves his toes up towards his shin, the side flex inserts 10 compress slightly, while the heel flex insert 9 expands slightly. In plantar flexion, i.e. when the player points his toes, then of course the side flex inserts expand while the heel flex insert compresses.

Figure 5:
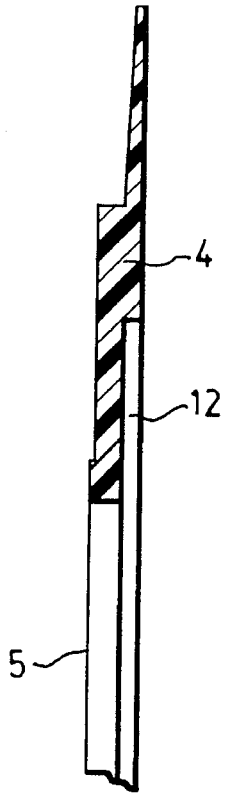
FIG. 5 is a section at A—A of FIG. 4.
Figure 6:
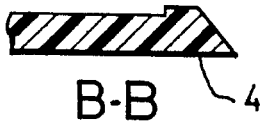
FIG. 6 is a section at B—B of FIG. 4.
Figure 7:
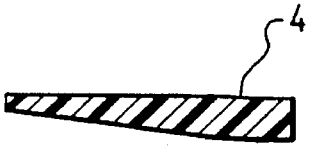
FIG. 7 is a section at C—C of FIG. 4.
Figure 8:
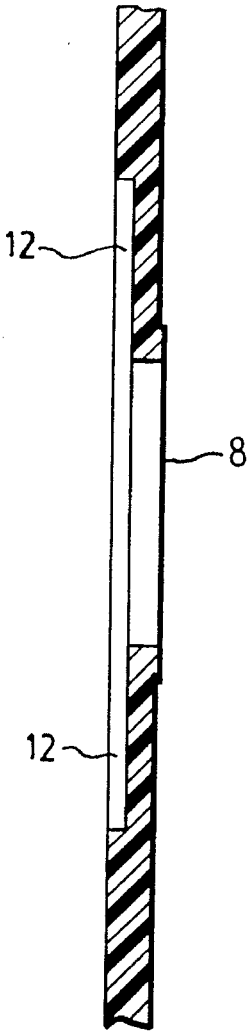
FIG. 8 is a section at D—D of FIG. 4.
Figure 9:
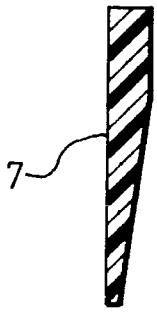
FIG. 9 is a section at E—E of FIG. 4.
Figure 10:
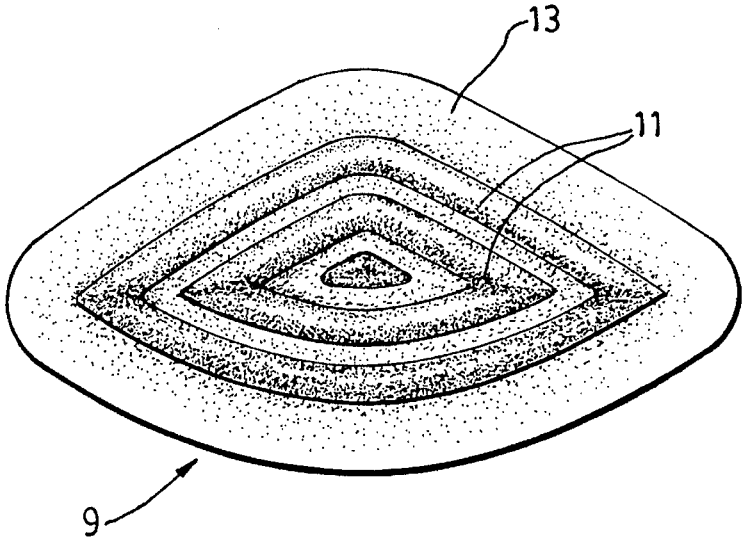
FIG. 10 is a plan view of the heel flex insert.
Figure 11:
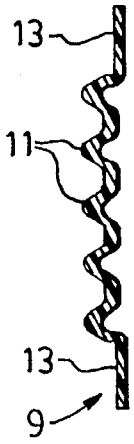
FIG. 11 is a cross-section of the heel flex insert.
Figure 12:
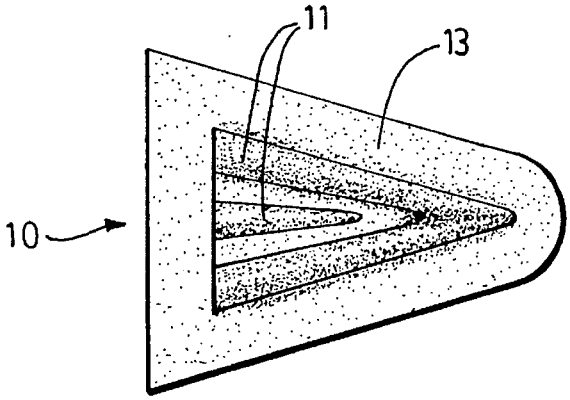
FIG. 12 is a plan view of one of the side flex inserts.
Figure 13:
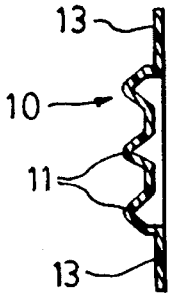
FIG. 13 is a cross-section of one of the side flex inserts.

If there are no inserts in the cut-out areas, then there is no added resistance to dorsal and plantar flexion. When inserts are used, flexion is provided by ensuring that the inserts may be expanded or compressed easily. Therefore, as seen in FIGS. 11 and 13, the inserts preferably have an accordion-fold profile, by virtue of corrugations 11. In order to retain the inserts in place, the overlay has molded undercut areas 12, as seen in FIGS. 5 and 8, to receive the flanged portions 13 of the inserts. Preferably, the overlay and inserts are sewn together, through the flanged portions, prior to installation on the skate boot.

By virtue of its thickness (e.g. about 0.100 inch), the overlay is somewhat inflexible, and increases the rigidity of the rear of the skate, particularly about a longitudinal axis by virtue of the continuity between the upper portion 4 and the side panels 7, and prevents or restricts pronation and supination. The actual thickness of the overlay is obviously not critical; varying degrees of thickness will produce varying degrees of restriction of pronation and supination.

The overlay and the inserts together obviously add impact resistance as well.

Inverted U-shaped cut-out areas 14 are provided between the rear portion 6 and side panels 7, not for the purpose of adding flexibility, but simply to reduce the amount of plastic required, since additional support in that area is not required, and to add visual impact to the skate. It should be readily appreciated that these latter cut-outs could be omitted, i.e. the overlay could be continuous around its lower aspect instead of being divided into rear and side panels.

It should also be appreciated that the heel flex insert 9 and side flex inserts 10 could be omitted, although in that event the impact resistance in those areas would not be quite as great.

It should also be appreciated that-the heel flex cut-out area 5 and the side flex cut-out areas 8 could be omitted, in which case a very rigid boot would be created, with limited dorsal and plantar flexion. Such a degree of rigidity may not be advantageous generally, but might be appreciated by some players.

It will be appreciated that the above description relates to the preferred embodiment by way of example only. Many variations on the invention will be obvious to those knowledgeable in the field, and such obvious variations are within the scope of the invention as described and claimed, whether or not expressly described.

WHAT IS CLAIMED AS THE INVENTION IS:

1. A skate boot having an upper with a back and medial and lateral sides, comprising a plastic overlay secured to said upper, said plastic overlay wrapping around a substantial portion of the back and adjacent portions of the medial and lateral sides of the boot, said plastic overlay having at least three portions cut-out therefrom so as not to inhibit flexion in said cut-out portions, said cut-out portions comprising a first cut-out portion across the back of the boot at approximately the level of the malleoli of a person wearing the boot, and second and third cut-out portions on each of the medial and lateral sides of the boot extending forwardly from just forward of the area of the malleoli to a forward edge of said overlay.

2. A skate boot as recited in claim 1, comprising further cut-out portions on the medial and lateral sides of the boot near the back thereof, extending from below the areas of the malleoli to a lower edge of the overlay, said further cut-out portions inherently reducing the weight of said overlay.

3. A skate boot as recited in claim 1, where said first, second and third cutout portions have flexible plastic inserts secured therein across said cut-out portions which permit compression or expansion within said cut-out areas.

4. A skate boot as recited in claim 2, where said first, second and third cutout portions have flexible plastic inserts secured therein across said cut-out portions which permit compression or expansion within said cut-out areas.

5. A skate boot as recited in claim 1, where said first, second and third cutout portions, as viewed from the side of the boot, are generally V-shaped, the points of the V-shapes being directed generally towards the areas of the malleoli, thus facilitating flexion of the boot around axes corresponding to the areas of the malleoli.

6. A skate boot as recited in claim 5, comprising further cut-out portions on the medial and lateral sides of the boot near the back thereof, extending from below the areas of the malleoli to a lower edge of the overlay, said further cut-out portions inherently reducing the weight of said overlay.

7. A skate boot as recited in claim 5, where said first, second and third cut-out portions have flexible plastic inserts secured therein across said cut-out portions which permit compression or expansion within said cut-out areas.

8. A skate boot as recited in claim 6, where said first, second and third cut-out portions have flexible plastic inserts secured therein across said cut-out portions which permit compression or expansion within said cut-out areas.

* * * * *